United States Patent [19]

Kallestad et al.

[11] 4,306,490

[45] Dec. 22, 1981

[54] FAN MOUNT FOR GRAIN DRYING AND STORAGE BIN

[75] Inventors: Daniel R. Kallestad; David F. Barr, both of Blue Earth, Minn.

[73] Assignee: Continental Agri-Services, Inc., Blue Earth, Minn.

[21] Appl. No.: 78,297

[22] Filed: Sep. 24, 1979

[51] Int. Cl.[3] ..... F26B 25/10

[52] U.S. Cl. ..... 98/55; 98/56; 34/233

[58] Field of Search ..... 98/52, 53, 54, 55, 56, 98/57, 6; 34/233

[56] References Cited

U.S. PATENT DOCUMENTS 3,417,487 12/1968 Harris ..... 98/55 X
4,037,527 7/1977 Steffen ..... 98/55

FOREIGN PATENT DOCUMENTS 726659 10/1942 Fed. Rep. of Germany ..... 98/56
46333 4/1936 France ..... 98/55

*Primary Examiner*—Albert J. Makay
*Assistant Examiner*—Harold Joyce
*Attorney, Agent, or Firm*—Dorsey, Windhorst, Hannaford, Whitney & Halladay

[57] ABSTRACT

An improved grain drying and storage bin of the type having side walls and a perforated floor defining a plenum chamber and a grain drying and storage chamber and an improved fan mounting therefor. The fan mounting arrangement includes an opening in the sidewall, a fan mounted with a portion above the level of the perforated floor, an angled housing extending from the top of the opening to the perforated floor and a plurality of vanes disposed on the interior surface of the housing to direct the air upwardly and outwardly into the grain drying and storage chamber.

13 Claims, 5 Drawing Figures

FAN MOUNT FOR GRAIN DRYING AND STORAGE BIN

BACKGROUND OF THE INVENTION

The present invention relates generally to the field of grain drying and storage bins and more particularly, to an improved fan mounting arrangement for such a grain drying and storage bin.

Grain drying and storage bins have existed in the prior art for many years. Such bins generally include a concrete base, a side wall forming a generally cylindrical housing of corrugated steel extending upwardly from the base and a roof. Within such housing, a perforated floor is supported in spaced relationship above the concrete base to provide a plenum chamber into which air is forced for circulation to the grain and a grain drying and storage chamber above the perforated floor into which the grain is introduced for drying and storage. Positioned near the bottom of the side wall of the bin about its periphery are a plurality of air circulation means in the form of ventilation and drying fans. In some structures these fans are mounted directly to the bin wall, while in others the fans are mounted separate from the wall with an external transition duct. These fans introduce air into the plenum chamber, the spaced located below the perforated floor, and force it upwardly through the perforated floor and through the grain during the drying process. A plurality of lamps or other source of heat may also be positioned about the periphery of the bin to assist in the drying process.

In the past, fans were mounted either to the side wall of the bin or spaced from the bin such that the entire fan outlet was positioned below the perforated floor. While this was a generally satisfactory mounting arrangement, it tended to result in in adequate and uneven airflow in the grain, particularly in the area near the fans. It was believed that these stagnant areas or areas or uneven airflow were formed as a result of a negative draft being created by the air forced into the plenum chamber past a portion of the underside of the floor, thus actually resulting in a downward flow of air from the grain through the perforated floor in the area of the fans. Another mounting arrangement for a fan in a grain drying and storage bin is to mount the fan such that a portion of the fan outlet is disposed above the perforated floor. Such a mounting arrangement is illustrated in U.S. Pat. No. 4,037,527. It was believed that by positioning a portion of the fan above the floor level, the negative draft situation, and thus the inadequate and uneven airflow in the grain at these locations would be eliminated. While this particular mounting arrangement was considered to be an improvement over the prior method of mounting the fan entirely below the floor level, it created certain additional problems. One of these was the build-up of fan back pressure in the area where the fan was positioned above the floor, thus resulting in fan vibration and reduced life, loosening of bolts, etc. Thus, there is a real need in the art for an improved fan mounting arrangement which eliminates the negative draft situation resulting from air being forced into the plenum chamber and which also eliminates the increased back pressure and fan vibration resulting from mounting a portion of the fan above the perforated floor level.

SUMMARY OF THE INVENTION

In contrast to the prior art, the present invention relates to an improved fan mounting arrangement which solves the problems existent in the prior art by eliminating the negative draft, and thus inadequate and uneven airflow resulting from introduction of air into the plenum chamber and also eliminating or significantly reducing any back pressure or fan vibration which may be caused by positioning a portion of the fan above the perforated floor level. Additionally, with the present arrangement, more air is allowed to flow through the grain thus resulting in a more efficient operation and a reduction of operating costs.

More particularly, the structure of the present invention includes an angled, perforated housing extending downwardly from near the upper perimeter of the fan opening to the perforated floor. The angled housing includes a centrally positioned upper surface and a pair of triangularly shaped side surfaces converging from the corrugated bin wall to the top surface of the perforated floor. The interior of the angled housing includes a plurality of vanes connected with the interior surface of the angled housing walls to direct incoming air upwardly and sidewardly through the walls of the housing into the grain. It has been found that this particular structure solves the problem of cold spots in the grain believed to be caused by the negative draft or downward movement of air through the perforated floor in the area of the fans and also significantly reduces or eliminates the back pressure and vibrations existent in prior art devices as a result of mounting the fan above the perforated floor level.

Accordingly, a main object of the present invention is to provide an improved fan mounting arrangement for a grain drying and storage bin which eliminates inadequate and uneven airflow in the bin near the fans.

Another object of the present invention is to provide an improved fan mounting arrangement in a grain drying and storage bin in which the aforementioned inadequate and uneven airflow is eliminated and the back pressure and fan vibrations caused by mounting the fan above the perforated floor level is eliminated.

A further object of the present invention is to provide an improved fan mounting arrangement for a grain drying and storage bin which increases the flow of air into the grain and thus proves improved efficiency.

Another object of the present invention is to provide the advantages mentioned above by introducing air into the grain drying and storage bin through use of an angled, perforated housing extending inwardly and downwardly from the wall of the grain bin to the top surface of the perforated floor.

These and other objects of the present invention will become apparent with reference to the drawings, the description of the preferred embodiment and the appended claims.

DESCRIPTION OF THE PREFERRED EMBODIMENT

Figure 1:
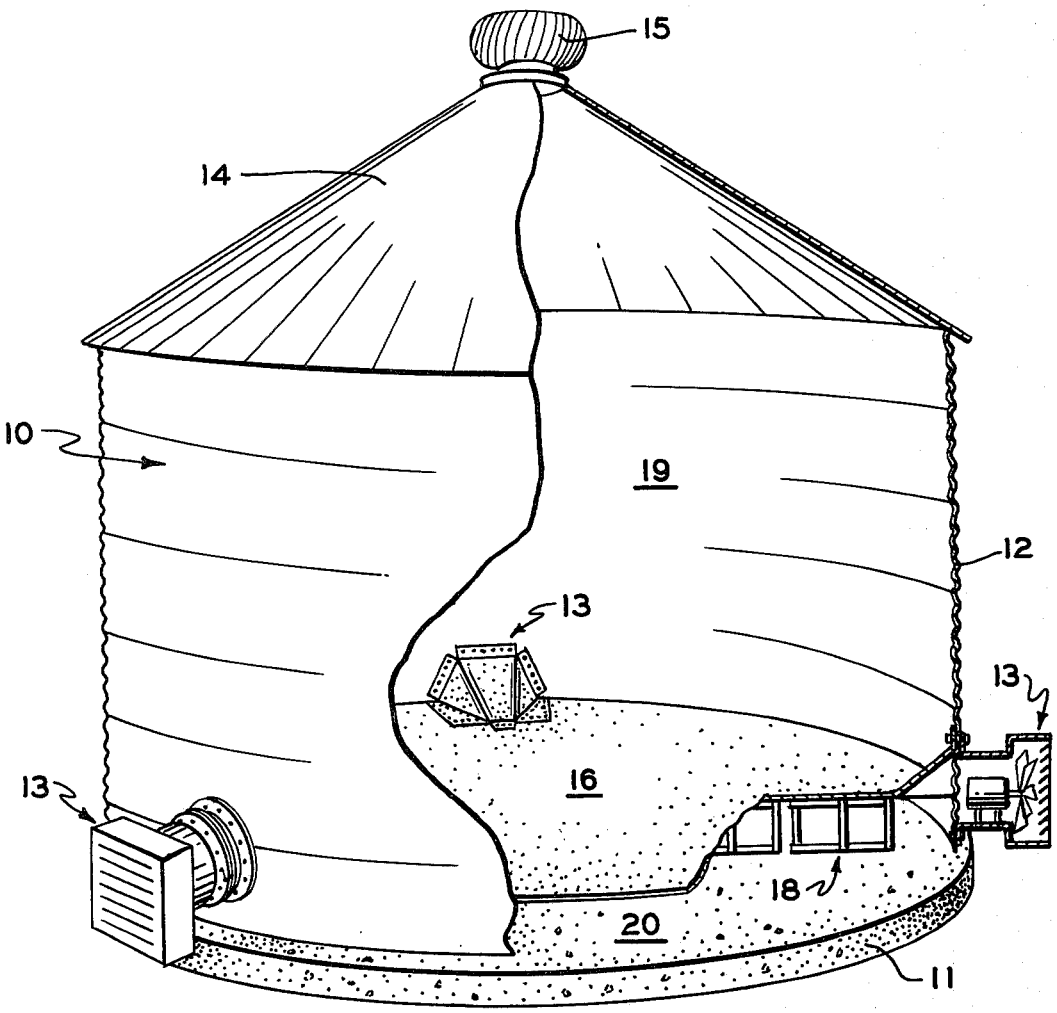
FIG. 1 is a pictorial view of a grain drying and storage bin showing the position of the fans and the fan mounting arrangement of the present invention.

Reference is first made to FIG. 1 which shows a pictorial view of a conventional grain drying and storage bin. Such bin includes a concrete base or platform 11, a generally cylindrical side wall 12 constructed of galvanized corrugated steel extending upwardly from the base 11 and an angled roof 14 sloping upwardly from the upper edge of the side wall 12. An exhaust port is located at the top of the roof 14 and a wind turbine 15 is positioned at the exhaust port to ventilate the attic of the bin. During the drying operation, however, the wind turbine 15 is moved to the side to allow air to freely escape through the exhaust port without restriction of the turbine 15. A perforated floor 16 is supported within the grain drying and storage bin in generally parallel relationship to, and spaced above, the base 11. The floor 16 defines a grain drying and storage chamber 19 above the floor and a plenum chamber 20 below. The perforated floor 16 is supported by a floor support system generally illustrated by the reference numeral 18 and made up of a plurality of floor support units. The floor support system supports the perforated floor in spaced relationship above the concrete platform 11 to permit air introduced by a plurality of fans or air circulation means 13 positioned about the lower periphery of the side wall 12 to force air into the plenum chamber 20, through the perforated floor 16, through the grain in the drying and storage chamber 19 and out through the exhaust port.

Figure 2:
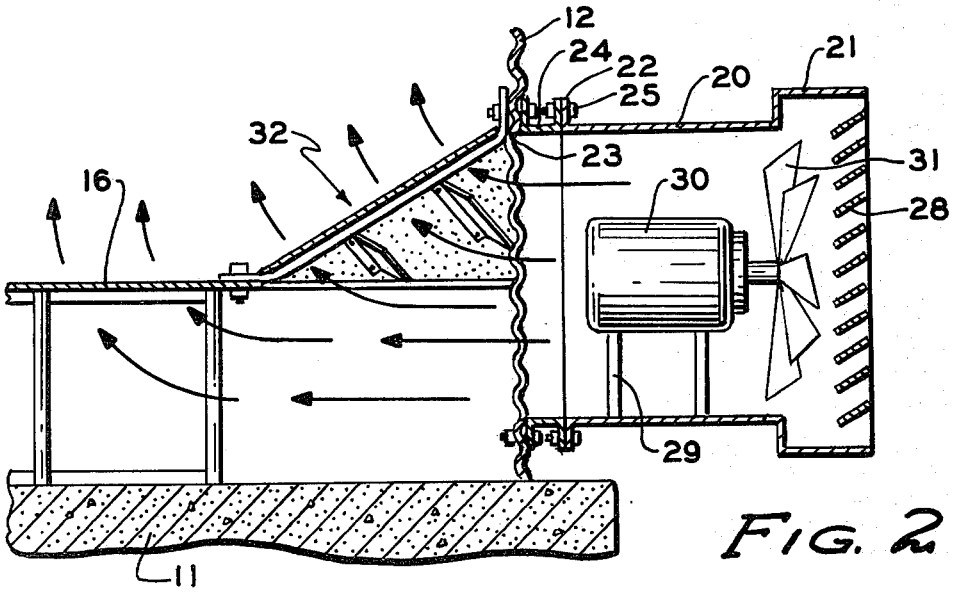
FIG. 2 is a side view, partially in section of a portion of grain drying and storage bin showing the details of the fan mounting arrangement.

With reference to FIGS. 1 and 2, a plurality of fans are positioned about the lower periphery of the grain bin 10. In the preferred embodiment, three or four such fans are equally spaced about the bin. Each of the fans in the preferred embodiment includes a generally cylindrical fan housing 20 connected by the channel member 24 to the side wall 12. The other end of the cylindrical fan housing 20 is connected to a generally rectangular baffle housing 21 which contains a plurality of inlet baffles 28. The housing 20 encloses the fan which consists of the motor 30 and the rotatable fan blades 31. The motor 30 is mounted centrally within the housing 20 by the motor support 29.

The housing 20, and thus the entire fan structure is mounted to the sidewall 12 by the circular channel 24. In particular, the peripheral housing lip member 22 is bolted to one leg of the channel member 24 by a plurality of peripheral screws or bolts 25. The other leg of the channel member 24 is connected directly to the bin wall 12 by a plurality of bolts or screws 26.

Figure 3:
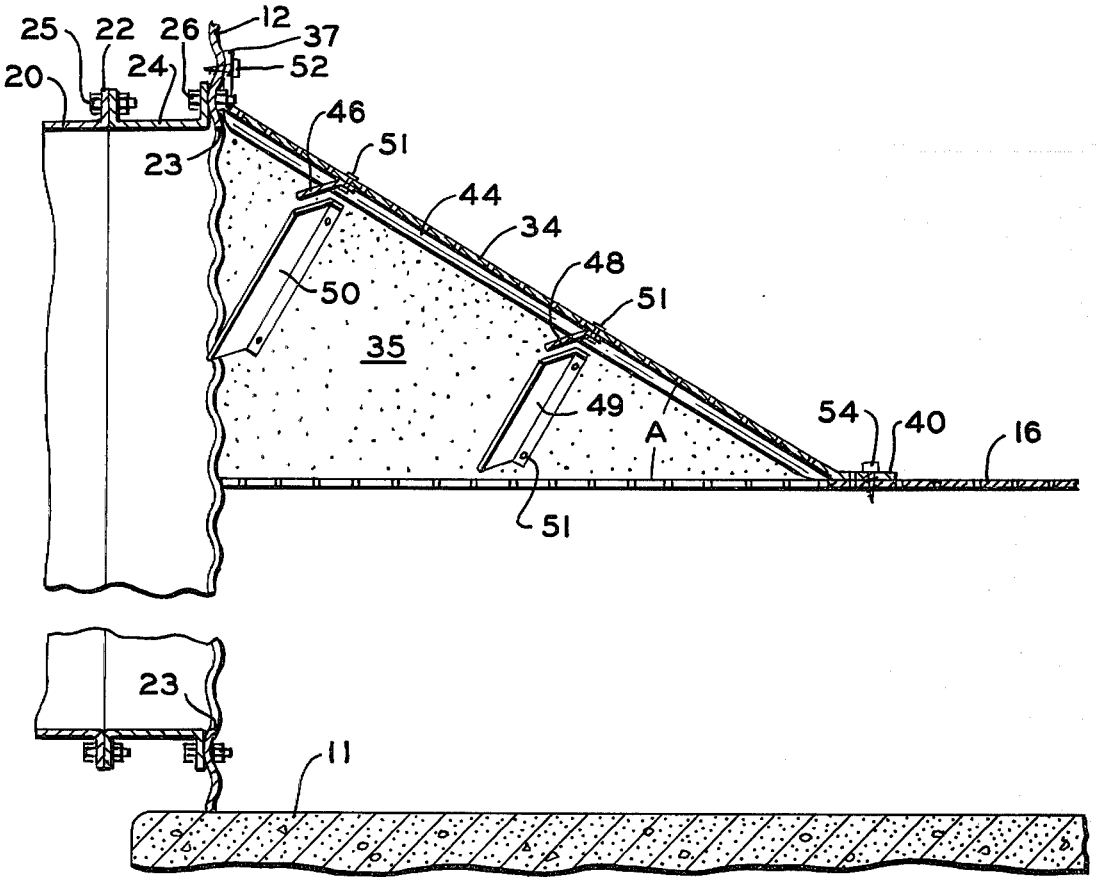
FIG. 3 is an enlarged side view of a portion of the grain drying and storage bin showing the fan mounting arrangement and angled housing in more detail.
Figure 4:
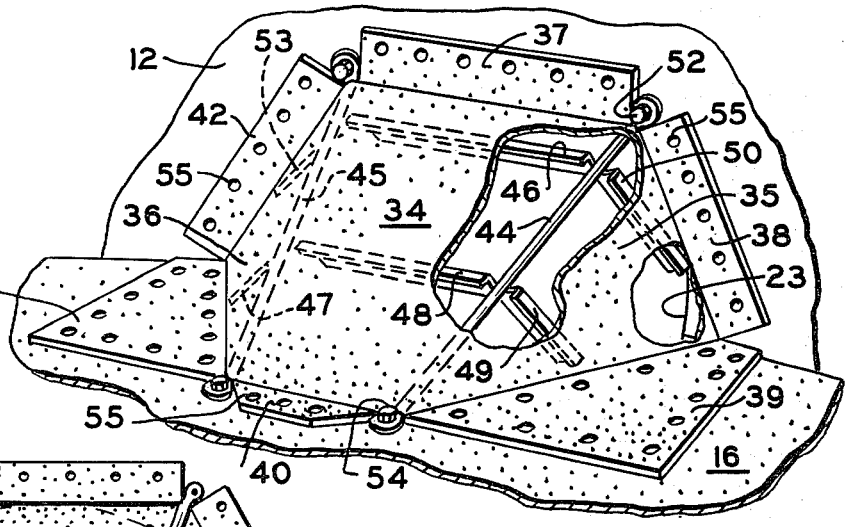
FIG. 4 is a pictorial view of the angled, perforated housing of the fan mounting arrangement as viewed from the inside of the grain drying and storage bin.
Figure 5:
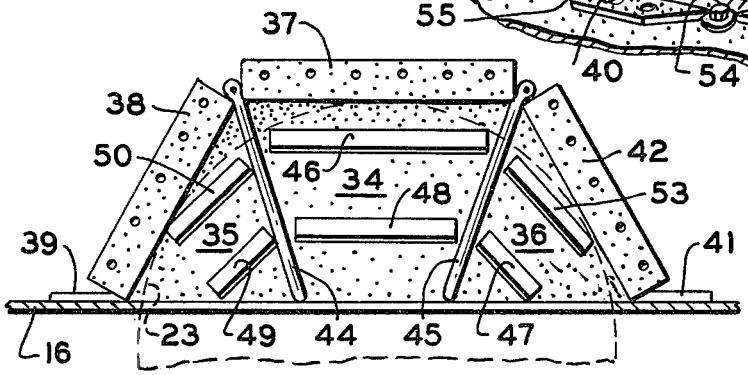
FIG. 5 is a pictorial view of the angled housing of the fan mounting arrangement of the present arrangement looking into the interior of the angled, perforated housing.

As also illustrated generally in FIG. 2 and more particularly in FIGS. 3–5, the fan is mounted relative to a circular opening 23 in the sidewall 12 for introduction of air into the plenum chamber 20. A first portion of the opening 23 is disposed below the perforated floor 16 and a second portion is disposed above. In the preferred embodiment, the opening 23 has a diameter of twenty-four inches with approximately 9½ inches above the floor 16 and approximately 14½ inches below. Thus, between one-fourth and one-half of the opening 23 is positioned above the floor 16. An angled, perforated housing member generally illustrated by the reference 32 extends from near the edge of the opening 23 above the floor downwardly and inwardly to the perforated floor 16. The angled housing 32 includes a generally trapezoidally shaped top section 34 having its major base connected with the interior of the bin side wall 12 and extending downwardly and inwardly with its minor base connected with the upper surface of the perforated floor 16. The angled housing also includes a pair of triangular shaped side walls 35 and 36 each having one of its legs connected with the bin side wall 12 and the other two of its legs connected with one edge of the top section 34 and the perforated floor 16, respectively.

As best illustrated in FIG. 4, the angled housing is supported with respect to the bin side wall 12 and the perforated floor 16 by a pair of supporting braces 44 and 45 and a plurality of peripheral flanges 37–42. In particular, the supporting braces 44 and 45 have one end connected with the bin sidewall 12 by appropriate bolts or screws 52 and the other end connected with the perforated floor 16 by appropriate bolts or screws 54. The braces 44 and 45 include end flanges which are bent relative to the main supporting central portion for appropriate connected to the sidewall 12 and floor 16. While the braces 44 and 45 can be constructed from a variety of materials having sufficient strength and rigidity, such members in the preferred embodiment are constructed of ¾ inch thin wall, electrical conduit with flattened out end portions to form connecting flanges. It should be noted that the bolt 52 connecting the braces 44 and 45 to the sidewall 12 includes a rubber washer on the outside to seal the bin and to prevent water or moisture from entering the grain around the bolt.

Each of the flanges 37–42 is integrally formed with an appropriate edge of the angled housing and is secured with respect to the sidewall 12 or the perforated floor 16 by a plurality of self tapping sheet metal screws approximately ½ inch in length. In particular, the flanges 42, 37 and 38, integrally joined with the sections 36, 34 and 35, respectively, and securely fastened to the bin sidewall 12, while the flanges 39, 40 and 41, integrally joined with the sections 35, 34 and 36, respectively, are securely fastened to the upper surface of the perforated floor 16. It should be noted that in manufacturing the angled housing 32, the entire housing plus the connecting flanges is constructed from a single sheet of perforated metal, similar to the material from which the perforated floor 16 is constructed. In the preferred embodiment, this perforated angular housing is constructed of 18 gauge perforated steel with 27% opening. Although many different types and thicknesses of perforated material can be used, the material in the preferred embodiment is manufactured by Western American Steel of Chicago, Ill.

In the preferred embodiment, the top section 34 extends from the sidewall 12 downwardly and inwardly to the perforated floor 16. The point at which the section 34 converges with the floor 16 is approximately twenty inches from the sidewall 12. Thus, as shown in FIG. 3, the angle "A" formed by the section 34 with the floor 16 is between about 20° and 40° and preferably about 30°. The portion of the perforated floor 16 enclosed by the angled housing is cut away, thus permitting air introduced by the fan to enter the plenum chamber. As the air is introduced, some is caught by the vanes and forced upwardly and outwardly through the angled, perforated housing. The remainder of the air is forced into the plenum chamber and upwardly through the perforated floor 16 in a conventional manner.

The interior of the angled housing includes a plurality of vane members or air scoops 46, 48, 49, 50, 47 and 53. Each of these vanes is a generally elongated member having a narrow base portion adapted for connection to its respective top 34 or side 35, 36 portions and a wider, air scoop portion extending outwardly from its respective angled wall. In the preferred embodiment, each of the vanes or air scoops 46, 48, 49, 50, 47 and 53 is constructed of 19 gauge galvanized metal which is bent at a specified angle to form the two aforementioned sections. The vanes are secured to their respective top and side walls by a plurality of pop rivets 51.

The purpose of the vanes 46, 48, 49, 50, 47 and 53 is to catch some of the air introduced by the fan and direct it through the walls 34, 35 and 36 into the grain. Accordingly, the vanes are disposed at an angle with respect to their supporting walls. In the preferred embodiment, such vanes are disposed at approximately a 45° angle relative to the supporting surface although it is contemplated that an angle approximately 10° or 15° more or less than 45° would be acceptable.

While the description of the preferred embodiment has been quite specific, it is contemplated that various modifications could be made to the specific embodiment without deviating from the spirit of the present invention. For example, the particular shape of the angled housing could be changed or modified. It is important, however, that the same extend from near the top of the fan opening to the perforated floor. Also, the particular configuration and/or number of vanes could be modified to serve the purpose of forcing air upwardly through the angled enclosure. Thus, it is intended that the scope of the present invention be dictated by the appended claims rather than by the description of the preferred embodiment.

We claim:

1. A grain drying and storage bin comprising:

a generally horizontal base;

a sidewall extending upwardly from said base;

a perforated floor extending to said side wall and spaced vertically above said base;

an opening in said sidewall for the introduction of air into the bin, a first part of said opening being below said perforated floor and a second part of said opening being above said perforated floor;

an air circulating means mounted externally of said sidewall for introducing air through said opening into the bin;

an angled, perforated housing extending from near the edge of said second part of said opening downwardly and inwardly to said perforated floor, said perforated floor being cut away in the area below said angled housing, said angled housing including a perforated top section having one edge secured to the inner surface of said sidewall and a pair of generally triangular, perforated side sections each having a first edge connected with a surface of said sidewall, a second edge connected with said perforated floor and a third edge connected with said top section.

2. The grain drying and storage bin of claim 1 wherein said top section includes a pair of side edges and said bin includes a pair of support braces disposed at the side edges of said top section, said braces having their top ends secured to said sidewall and their lower ends secured to said perforated floor.

3. The grain drying and storage bin of claim 2, wherein said angled housing consists of a single piece of perforated material having edge flanges at the outer edges of said top and side sections for securing the same to said sidewall and perforated floor.

4. The grain drying and storage bin of claim 3 including a plurality of air vanes secured to the underside of said angled housing for directing incoming air upwardly through the perforations in said angled housing into the bin.

5. The grain drying and storage bin of claim 4 wherein said air vanes extend outwardly from said housing and generally toward said opening.

6. The grain drying and storage bin of claim 5 having a pair of air vanes in each of said top and side sections.

7. The grain drying and storage bin of claim 1 including a plurality of air vanes secured to the underside of said angled housing for directing incoming air upwardly through the perforations in said angled housing into the bin.

8. The grain drying and storage bin of claim 7 wherein said air vanes extend outwardly from said housing and generally toward said opening.

9. In a grain drying and storage bin having a generally horizontal base, a sidewall extending upwardly from said base and a perforated floor extending generally to said sidewall and spaced vertically above said base, the improvement comprising:

an opening in said sidewall for the introduction of air into the bin, a first part of said opening being below said perforated floor and a second part of said opening being above said perforated floor;

an air circulating means mounted externally of said sidewall for introducing air through said opening into the bin;

an angled, perforated housing extending from near the edge of said second part of said opening downwardly and inwardly to said perforated floor, said perforated floor being cut away in the area below said angled housing, said angled housing including a generally trapezoidally shaped, perforated top section having its major base secured to a surface of said sidewall and its minor base secured to said perforated floor and a pair of generally triangular, perforated side sections each having one leg secured to a surface of said sidewall, a second leg secured to said perforated floor and a third leg secured to a side edge of said top section.

10. The grain drying and storage bin of claim 9 wherein between about one-fourth and one-half of said opening is disposed above said perforated floor.

11. The grain drying and storage bin of claim 9 wherein each of said side sections slopes outwardly from said top section toward said perforated floor.

12. The grain drying and storage bin of claim 11 wherein said top section forms an angle of between 20° and 40° with respect to said perforated floor.

13. The grain drying and storage bin of claim 12 wherein said top section forms an angle of about 30° with respect to said perforated floor.

* * * * *